US006049923A

United States Patent [19]

Ochiai

[11] Patent Number: 6,049,923

[45] Date of Patent: Apr. 18, 2000

[54] LIFT FOR LIFTING AND LOWERING BODY

[76] Inventor: Shigeyoshi Ochiai, 9-23-106, Ochiai 5-chome, Tama-shi Tokyo 206-0033, Japan, 206-0033

[21] Appl. No.: 09/165,118

[22] Filed: Oct. 2, 1998

[30] Foreign Application Priority Data

Oct. 3, 1997 [JP] Japan ..... 9-309178

[51] Int. Cl.[7] ..... A61G 7/10

[52] U.S. Cl. ..... 5/88.1; 5/83.1; 5/84.1; 5/85.1; 5/86.1

[58] Field of Search ..... 5/81.1 R, 88.1, 5/83.1, 86.1, 87.1, 84.1, 89.1, 85.1

[56] References Cited

U.S. PATENT DOCUMENTS

| | | | |
|---|---|---|---|
| 33,545 | 10/1861 | Roth | 5/85.1 |
| 197,992 | 12/1877 | Brown | 5/86.1 |
| 669,450 | 3/1901 | Stephens | 5/85.1 |
| 1,122,825 | 12/1914 | Wasley | 5/86.1 |
| 1,270,136 | 6/1918 | Finley | 5/86.1 |
| 1,511,477 | 10/1924 | Jepson | 5/84.1 |
| 2,203,204 | 6/1940 | Nicolai | 5/83.1 |
| 3,882,554 | 5/1975 | Glass | 5/83.1 X |
| 4,058,860 | 11/1977 | Daidone | 5/83.1 X |
| 4,397,051 | 8/1983 | Wheeler | 5/84.1 |
| 5,539,941 | 7/1996 | Fuller | 5/88.1 X |
| 5,544,371 | 8/1996 | Fuller | 5/88.1 X |

FOREIGN PATENT DOCUMENTS

| | | | |
|---|---|---|---|
| 105583 | 9/1899 | Germany | 5/85.1 |
| 4795 | 5/1915 | United Kingdom | 5/83.1 |

*Primary Examiner*—Terry Lee Melius
*Assistant Examiner*—Robert G. Santos
*Attorney, Agent, or Firm*—Leydig, Voit & Mayer, Ltd.

[57] ABSTRACT

The present invention provides a lift which can stop at any height upon lifting and lowering a body. The lift of the present invention for lifting and lowering the body is provided with a rotating portion including a winding reel for winding a string, a friction reel for generating friction on the string and a sliding reel for holding the string slidable, these reels being unified; a common rotating shaft penetrating the center of the rotating portion for supporting the rotating portion; a rotating device for rotating the rotating portion; a string whose one end is fixed on a circumference of the winding reel and wound for plural times thereon, then reaching and rounding a first assist reel, then reaching and rounding the friction reel and then reaching and rounding the second assist reel, then the other end thereof being looped on the sliding reel to be terminated; a common center shaft penetrating the center axes of the first assist reel and the second assist reel; and a first suspending portion coupled to the common center shaft for suspending the body and making the common center shaft parallel to the common rotating shaft of the rotating portion.

8 Claims, 9 Drawing Sheets

LIFT FOR LIFTING AND LOWERING BODY

BACKGROUND OF THE INVENTION

1. Field of the Invention

The present invention relates to a lift for lifting and lowering a body such as a human body and a load smoothly and continuously with a small power, and more particularly to a lift for lifting and lowering handicapped people.

2. Description of the Prior Art

Usually, for nursing handicapped people, for example, lifting/lowering them to/from a bed and giving them a bath, many kinds of lifts for lifting and lowering a human body with a small power are provided. These lifts employ a human power such as a gear, a pulley and a screw, and also employ an external power, for example, electric power, oil pressure and water pressure.

A winding winch is provided for a lift using a human power, such as a gear, a pulley and a screw. In this case, a ratchet gear mechanism having a back-stop claw as a lowering stop mechanism is utilized when a body is lowered gradually.

This mechanism, however, needs a gear and a claw, therefore its size becomes large and its lowering speed is not smooth, because it rewinds the wire wound around the winch by reengaging the claw.

Although a screw system can provide a continuous smooth lifting and lowering, it needs a long screw having many screw threads for moving for a long distance, so the system cannot be small size.

In a lift using an external power, for example, electricity and water, lifting and lowering are smooth and it can stop while lowering, however, the equipment thereof is complicated and the product price is rather expensive.

In this way, there are many kinds of technologies for lifting and lowering the body including the human body and the load, but they have demerits as stated above. There have been longing a lift lowering a body continuously and smoothly which is used for lifting and lowering a seat of a wheelchair and a simple lift used for helping people confined to bet to change the bed seats and a futon (bedding) and to care for their toilets, or a small sized and light weighed portable lift which is used for going up or going down the stairs.

SUMMARY OF THE INVENTION

It is an object of the present invention to provide a simple, compact and light weighted lift for lowering a body smoothly with applying brake, and also for stopping at any position.

According to an aspect of the invention, a lift for lifting and lowering an object includes a rotating portion including a winding reel for winding a string, a friction reel for generating friction on the string and a sliding reel for holding the string slidable, these reels being unified; a common rotating shaft penetrating the center of the rotating portion for supporting the rotating portion; a rotating device for rotating the rotating portion; a string whose one end is fixed on a circumference of the winding reel and wound for plural times thereon, then reaching and rounding a first assist reel, then reaching and rounding the friction reel and then reaching and rounding the second assist reel, then the other end thereof being looped on the sliding reel to be terminated; a common center shaft penetrating the center axes of the first assist reel and the second assist reel; and a first suspending portion coupled to the common center shaft for suspending a body and making the common center shaft parallel to the common rotating shaft of the rotating portion.

Preferably, a belt is used as the string, the common rotating shaft is supported by supports, the common rotating shaft is supported by second suspending portion.

Further preferably, the common rotating shaft is comprised of a shaft of the wheels, and a board carrying the body is engaged on the common center shaft.

Further preferably, the second suspending portion is engaged to the shaft of the wheels of the carrier, and the first suspending portion is engaged to a board on which the body is carried or directly to the body.

According to another aspect of the invention, two sets of the winding reels, the friction reels and the sliding reels are unified on the common rotating shaft, and two sets of the first assist reel and the second assist reel have a common rotating shaft, and the first suspending portion coupled to the common center shaft suspends the body and makes the common center shaft parallel to the common rotating shaft of the rotating portion.

BRIEF DESCRIPTION OF THE DRAWINGS

The present invention will become more fully understood by the accompanying drawings which are given by way of illustration only, and thus are not limitative of the present invention, and wherein.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Embodiment 1.

A first embodiment of the present invention is explained in detail below.

Figure 1:
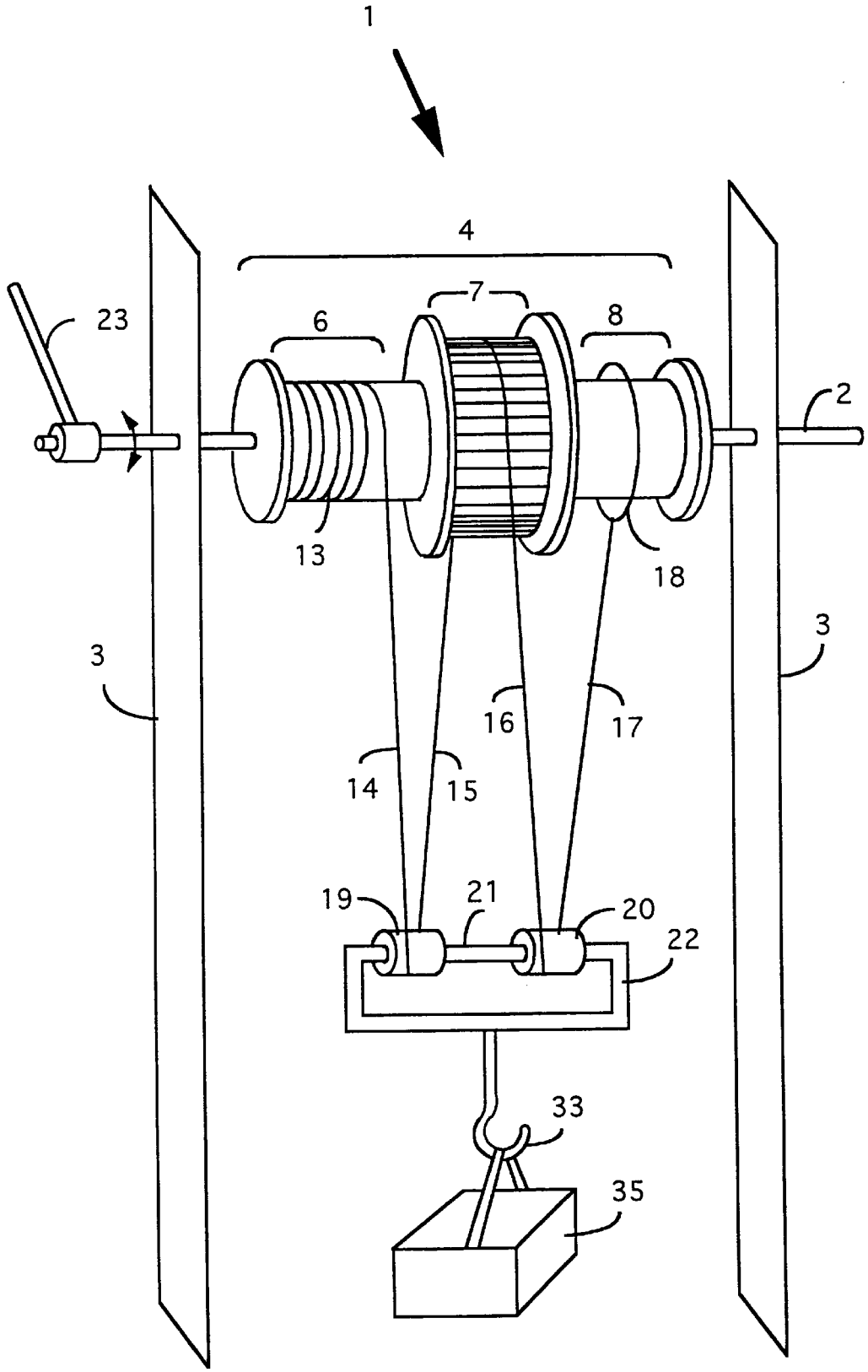
FIG. 1 shows a lift according to a first embodiment of the present invention.

FIG. 1 shows a lift having supports at both ends of the rotating portion 4 of a first embodiment of the present invention. In the lift of FIG. 1, the lift includes a rotating portion 4 comprising a winding reel 6, a friction reel 7 and a sliding reel 8 which are entirely integrated to a common rotating shaft 2. The rotating portion 4 rotates around the common rotating shaft 2. The lift also includes a first assist reel 19 and a second assist reel 20 for coupling with the winding reel 6, the friction reel 7 and a sliding reel 8 by a string, a common center shaft 21 which penetrates the center axis of the assist reels 19 and 20, a suspending portion 22 which is coupled to the common center shaft 21 for suspending a body, a string (13–18), and a support 3 for supporting a common rotating shaft 2 and a rotating device 23 for rotating the rotating portion 4. The one end of the string (13–18) are fixed on the circumference of the winding reel 6 and wound for plural times, then reaches and rounds the first assist reel 19, then reaches and rounds the friction reel 7 and then reaches and rounds the second assist reel 20, then the other end thereof is looped on the sliding reel 8 to be terminated.

Figure 5:
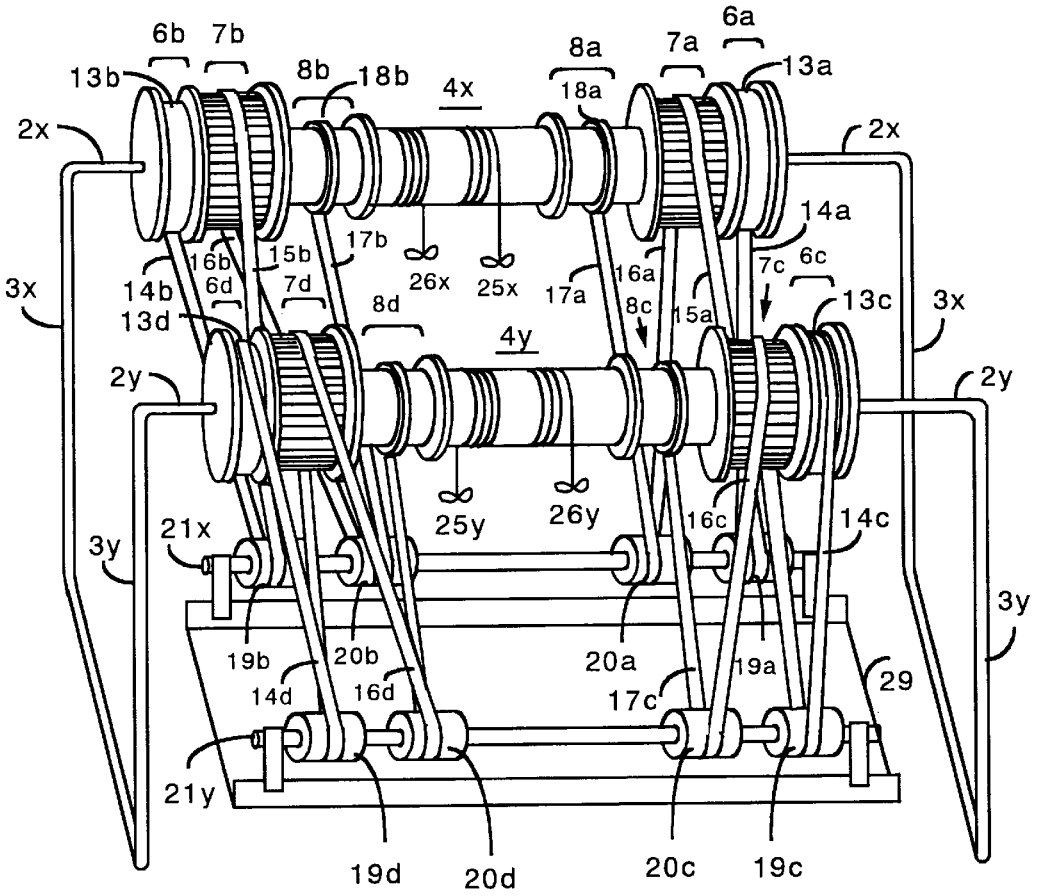
FIG. 5 shows a specific example of a lift according to an embodiment of the present invention.

As shown in FIG. 5, a rotating device 23 for rotating the rotating portion 4 may be pulling strings 25*x* and 26*x* for lifting and lowering which are wound on the rotating portions 4*x*, respectively. The strings 13–18 also may be a belt with a certain width.

Lifting the body 35:

In FIG. 1, the rotating device 23 rotates the rotating portion 4 to the counterclock direction seen from the rotating device 23, so that the string 14 is wound on the winding reel 6 of the rotating portion 4, while the string 16 is also wound on the friction reel 7. Therefore, the common center shaft 21 and the suspending portion 22 go up and the body 35 suspended by the suspending portion 22 also goes up. The detailed explanation thereof will be described later. At this time, the strings 15 and 16 become stable state, which means that the strings 15 and 16 do not slide due to the friction of the friction reel 7. Thus, when the rotating device 23 rotates the rotating portion 4 to the counterclock direction seen from the rotating device 23, the body 35 is lifted.

Lowering the body 35:

In FIG. 1, the rotating device 23 rotates the rotating portion 4 to the clock direction seen from the rotating device 23, so that the string 14 is fed from the winding reel 6 of the rotating portion 4, while the string 16 is also fed from the friction reel 7. Therefore, the common center shaft 21 and the suspending portion 22 go down and the body 35 suspended by the suspending portion 22 also goes down. The detailed explanation thereof will be described later. At this time, the strings 15 and 16 become stable state, which means that the strings 15 and 16 do not slide due to the friction of the friction reel 7. Thus, when the rotating device 23 rotates the rotating portion 4 to the clock direction seen from the rotating device 23, the body 35 is lowered.

Figure 2A:
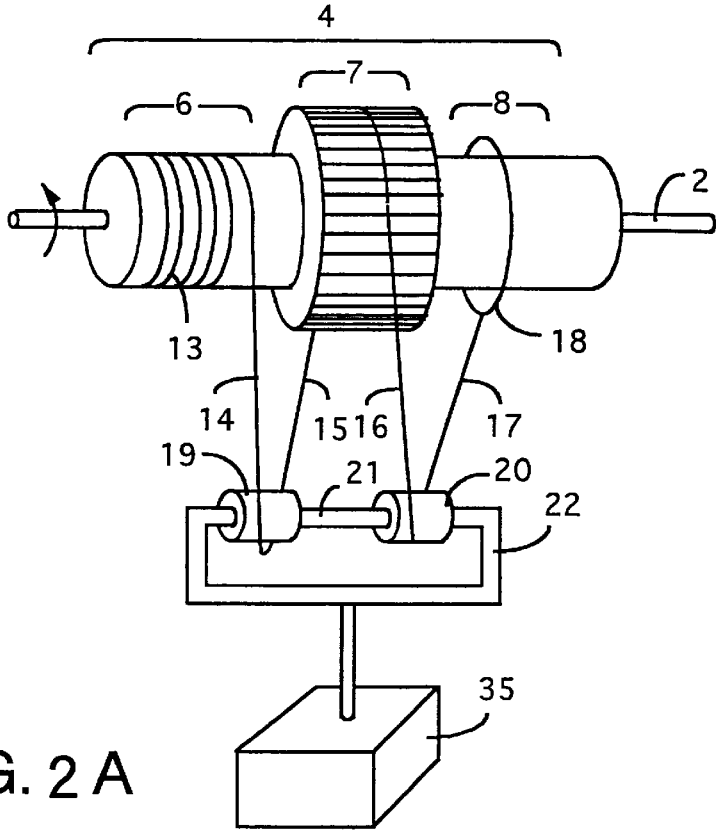
FIGS. 2A and 2B explain a principle of a first embodiment in the present invention in which assist reds go up and down when a rotating portion rotates.

Operation principle for lifting the body 35:

FIG. 2A explains a principle of a first embodiment in the present invention in which assist reels go up when a rotating portion rotates. In FIG. 2A, when the rotating portion 4 rotates to the counter-clock direction, the string 16 is pulled corresponding to the rotation of the friction reel 7 of the rotating portion 4 and thus the position of the second assist reel 20 is lifted. At this time, since the string 17 is formed as a loop around the sliding reel 8 and thus the string 17 is not pulled according to the rotation of the sliding reel 8, the strings 16 and 17 keep the tension, that is, the strings 16 and 17 are not loosened on the second assist reel 20. On the other hand, on the first assist reel 19, the string 14 is wound and pulled up by the winding reel 6 and the string 15 is fed from the friction reel 7, so that the strings 14 and 15 do not raise the position of the first assist reel 19 if the radius (R) of the winding reel 6 and the radius (r) of the friction reel 7 are the same. Since the position of the second assist reel 20 is lifted as stated above, the strings 14 and 15 are loosened at the first assist reel 19. Accordingly, the string 15 coupled with the friction reel 7 is not tense, so the string 15 is pulled by the string 16 and slides on the friction reel 7 and the position of the assist reel 20 lowers a little bit. Due to this sliding of the string 15, the second assist reel 20 lowers until the height of the first assist reel 19 and the second assist reel 20 are the same height, so that the looseness of the first assist reel 19 disappears and the sliding of the string 15 stops.

This process is carried out for every instance when rotating portion 4 rotates, and the assist reels 19 and 20 and the suspending portion 22 coupled thereto is lifted by the strings 14–17. In other words, when the rotating portion 4 rotates, the suspending portion 22 keeps the common center shaft 21 horizontal in the same height as the rotating portion 4, and the common center shaft 21, that is, the suspending portion 22 and the body 35 are lifted gradually.

When the rotating portion 4 stops rotating, the strings 15 and 16 on the friction reel 7 are applied with the same tension, so that the rotation of the rotating portion 4 is braked by the friction, and the suspending portion 22 and the body 35 stop at this position and do not fall down.

Figure 2B:
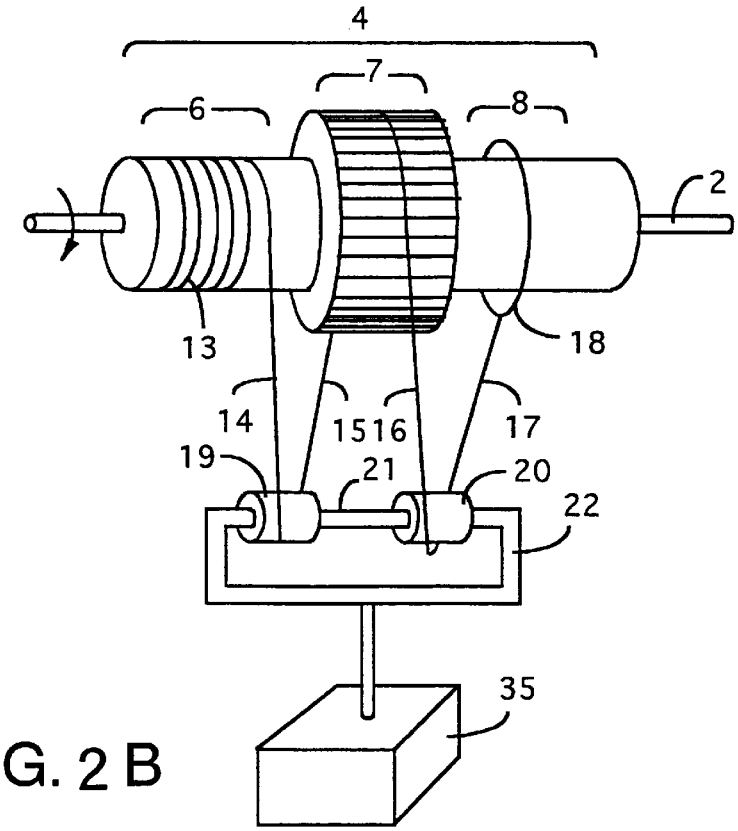

Operation principle for lowering the body 35:

FIG. 2B explains a principle of a first embodiment in the present invention in which assist reels go down when a rotating portion rotates. In FIG. 2B, when the rotating portion 4 rotates to the clock direction, the string 14 is fed from the winding reel 6 to the first assist reel 19 and the string 15 is pulled by the friction reel 7. If the radius of the winding reel 6 (R) and the radius of the friction reel 7 (r) are the same, the string 14 is fed by the winding reel 6 and the string 15 is fed from the friction reel 7, so that the strings 14 and 15 do not raise the position of the first assist reel 19. On the other hand, at the second assist reel 20, since the string 18 is looped on the sliding reel 8, the string 17 is not fed from the sliding reel 8 and the string 16 is fed from the friction reel 7, so that the strings 16 and 17 are loosened at the second assist reel 20. Accordingly, the string 16 coupled with the friction reel 7 is not tense, so the string 16 is pulled by the string 15 and slides on the friction reel 7 and the position of the assist reel 19 lowers a little bit. Due to this sliding of the string 16, the first assist reel 19 lowers until the height of the first assist reel 19 and the second assist reel 20 are the same height, so that the looseness of the second assist reel 20 disappears and the sliding of the string 16 stops.

This process is carried out for every instance when rotating portion 4 rotates, and the assist reels 19 and 20 and the suspending portion 22 coupled thereto is lowered by the strings 14–17. In other words, when the rotating portion 4 rotates, the suspending portion 22 keeps the common center shaft 21 horizontal in the same height as the rotating portion 4, and the common center shaft 21, that is, the suspending portion 22 and the body 35 are lowered gradually.

Braking principle on the rotating portion:

The principle for braking the rotating portion 4 is explained below, when the rotating portion 4 is not rotated by the rotating device 23.

If the friction does not occur on the friction reel 7, the strings 15 and 16 slide and the suspending portion 22 lowers until the string 13 wound on the winding reel 16 completely is unwind. However, if the friction occurs on the friction reel 7 of the rotating portion 4, the rotation force is generated on the friction portion due to the tension difference between the strings 15 and 16. If the tension of the strings 15 and 16 are the same, the rotating portion 4 does not rotate and the strings are not fed.

Figure 3:
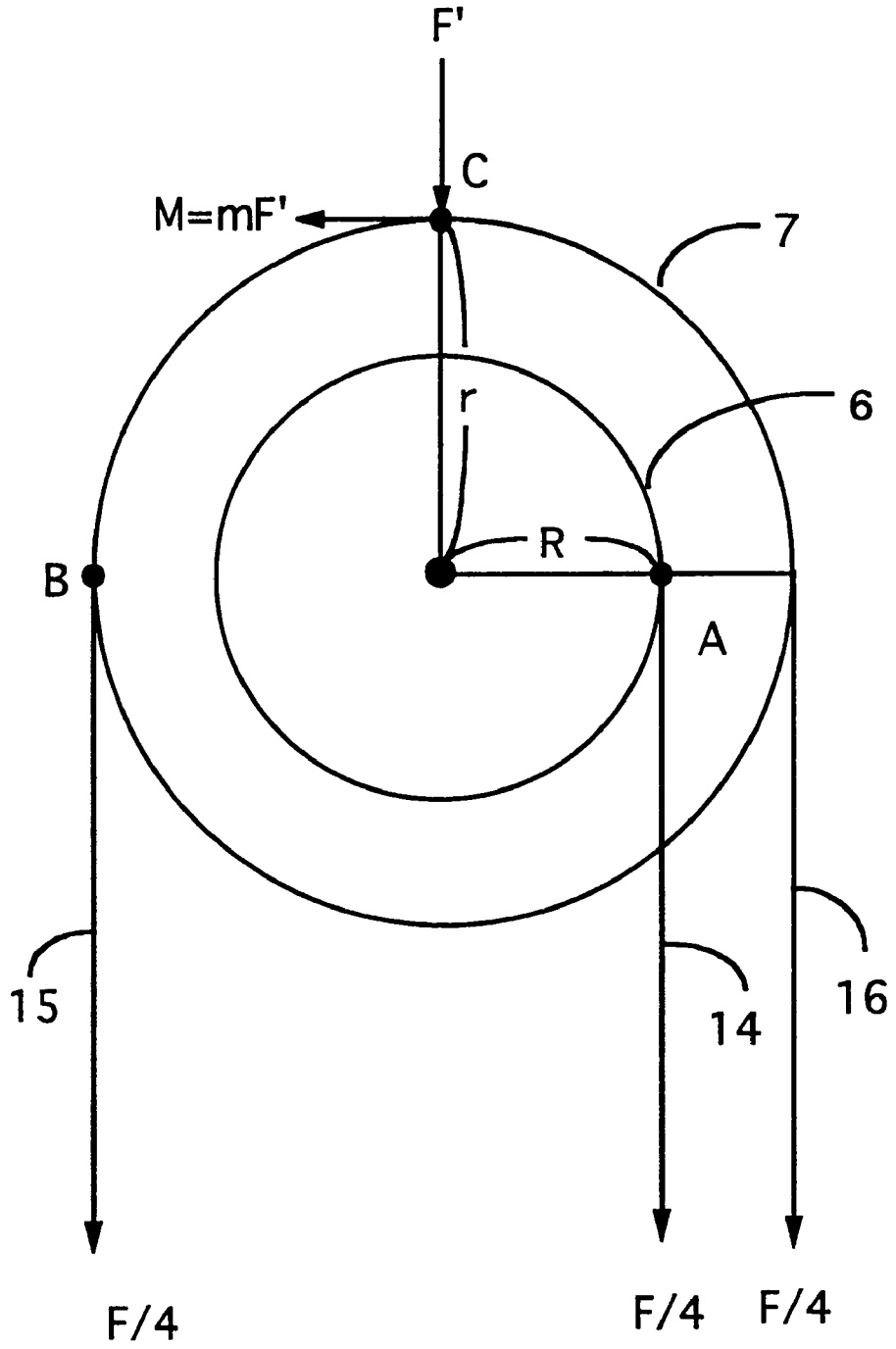
FIG. 3 explains a rotation moment working on the rotating portion of the present invention.

FIG. 3 explains the rotation moment effected on the rotating portion 4. At first, the strength of tension of the strings 15 and 16 on the friction reel 7 is explained. It is assumed that there is not friction between the string and the reel at the assist reels 19 and 20 below. When the external rotating force is not applied to the rotating portion 4 by the rotating device 23, the gravity F by the body 35 suspending to the suspending portion 22 is applied to the strings 15 and 16 equally on the friction reel 7. In this case, equal tension F/4 is applied to the four strings 14, 15, 16 and 17. Accordingly, at a point C of the friction reel 7, the gravity F'=2×F/4=F/2 is applied. Due to this gravity, at the C point of the friction reel 7, the friction force M is given by the following equation (1).

$$M=mF'=m\times F/2 \quad (1)$$

Where, m is a friction factor. Due to this friction force M, the strings 14 and 15 do not slide down and stop the rotation of the rotation portion 4.

In order to prevent sliding the string 15 down, the friction force M must be larger that the tension of the strings. Namely, $$r\times M>R\times F/4 \quad (2)$$

When M=m×F/2 is substituted for the equation (2), the following condition is obtained.

$$r\times m\times F/2>R\times F/4 \quad (3)$$

namely, $$M\times r>R/2 \quad (4)$$

When the above condition is satisfied, the sliding of the strings are effectively stopped due to the friction.

If r is equal to R, m>0.5 from (4), and if r is equal to 2R, m>0.25 from (4).

Thus, if the radius (r) of the friction reel 7 is larger than the radius (R) of the winding reel 6, the rotation of the rotating portion 4 can be prevented, even if the friction factor m is small.

Accordingly, for example, when r=R, if m<0.5, the rotation of the friction reel 7 cannot be stopped by the friction on the friction reel 7 since the strings loosened by the gravity. On the other hand, if the above condition is satisfied, the rotation of the rotating portion 4 can be prevented by the friction on the friction reel 7.

It is easily understood from the above formula (4) that the strings always slide down when r<0.5 R even if the friction factor m=1 at maximum, and r=0.5 R is a critical condition for preventing the sliding of the strings.

In order to prevent lowering the suspending portion 22, r>R is selected, and the material having the friction factor m>0.5 is applied on the friction portion of the friction reel 7.

As explained above, in the present invention, the assist reel is lifted or lowered by ¼ lengths of the string wound or fed by the winding reel 6. In other words, only when the rotating portion 4 is rotated by the rotating device 23, the suspending portion 22 and the body 35 are lifted or lowered. When the rotation of the rotating portion 4 is stopped, the suspending portion 22 and the body 35 stop lifting or lowering.

Using a handle having a ratchet mechanism as the rotating device 23 and making the length of the handle longer, the body 35 can be lifted or lowered by the small power.

Embodiment 2.

Figure 4A:
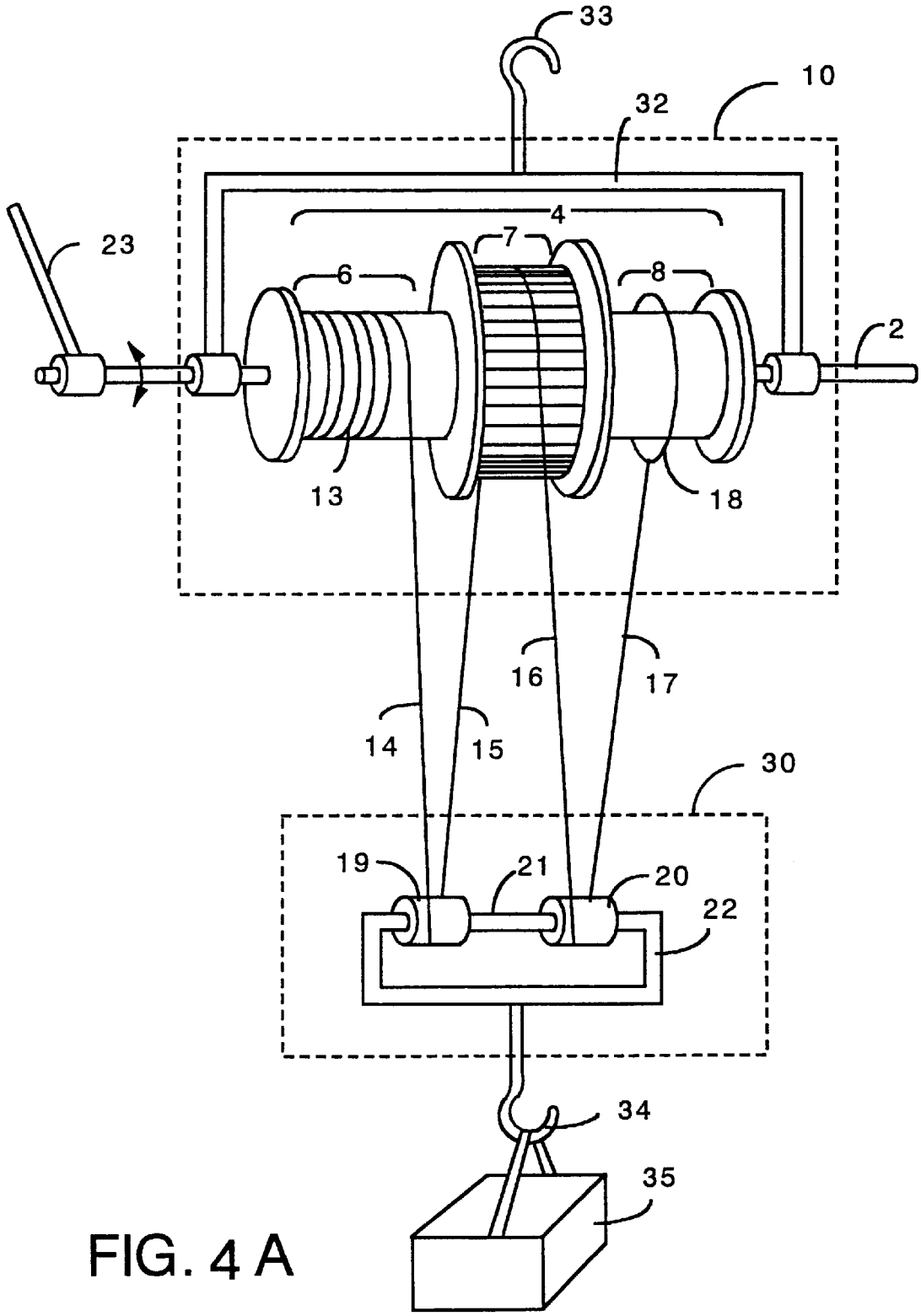
FIGS. 4A, 4B and 4C show lifts of a second embodiment of the present invention.
Figure 4B:
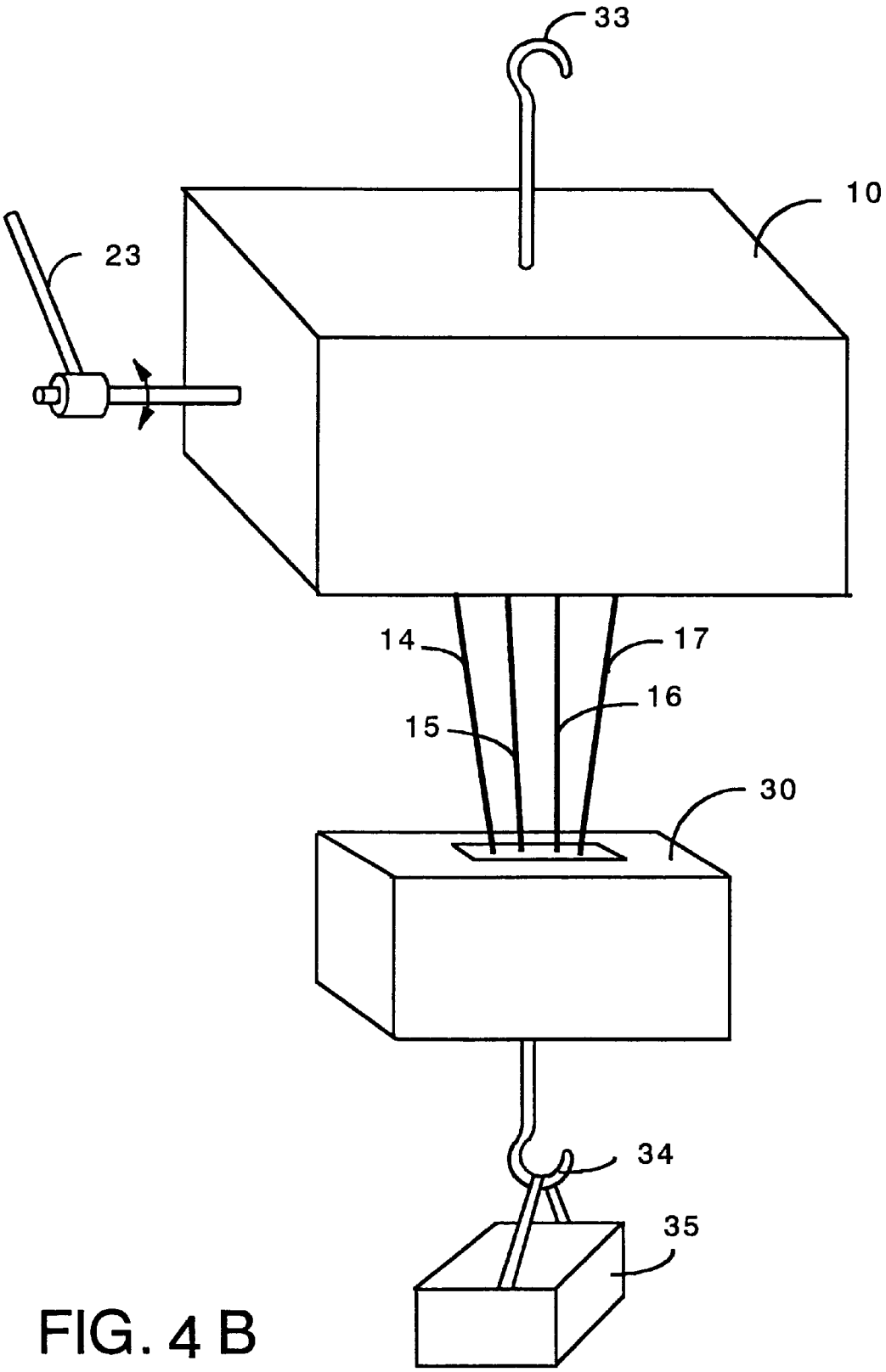
Figure 4C:
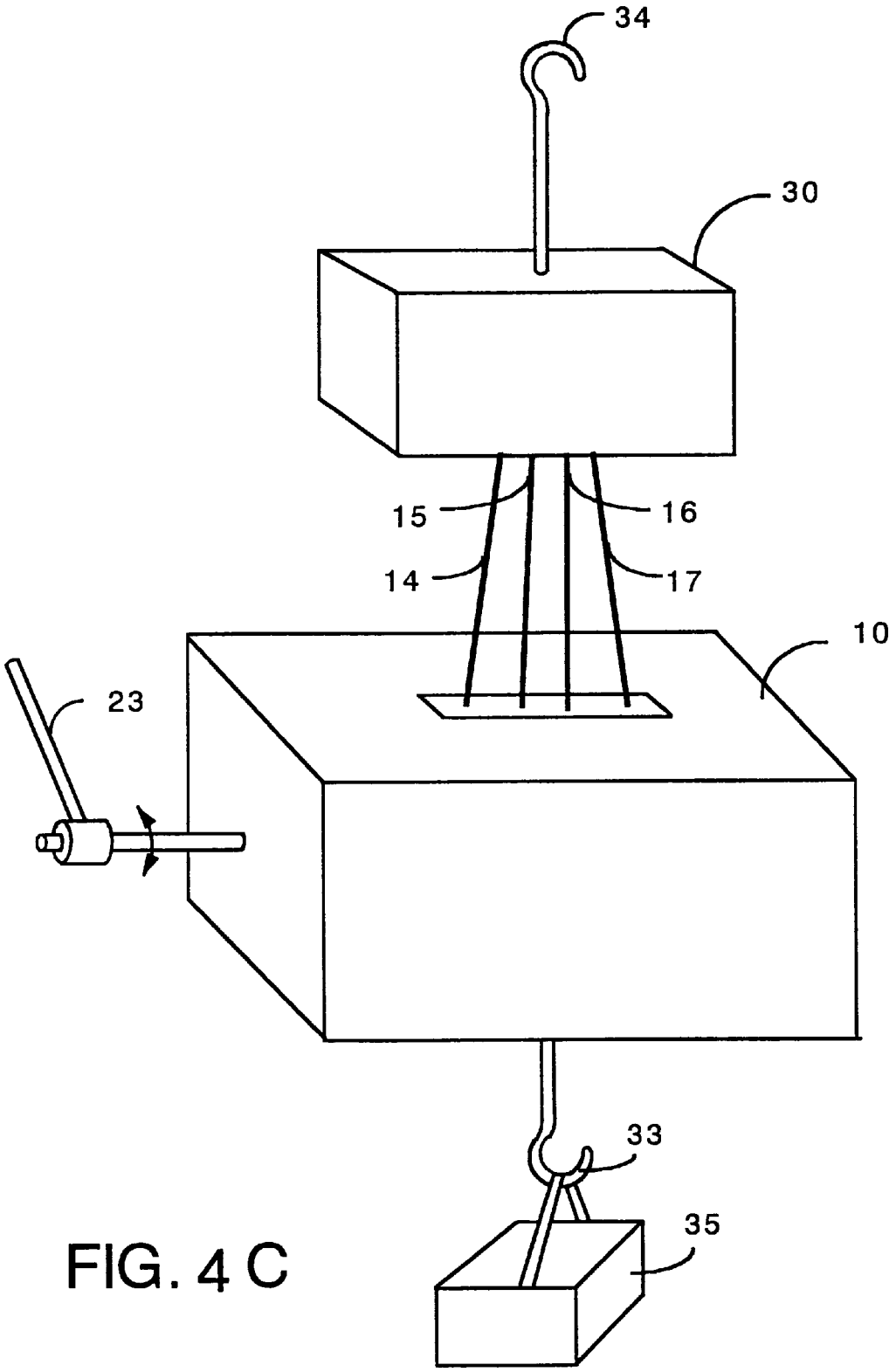

FIGS. 4A–4C show a lift of the second embodiment of the present invention.

In FIG. 4A, the rotating portion 4 of FIG. 1 is put in a main box 10, the assist reels 19, 20, the common center shaft 21 and the suspending portion 22 are put in a sub-box 30. The lift of FIG. 4A has a suspending portion 32 coupled to the common rotating shaft 2 of the rotating portion 4 and a hook 33 provided at the suspending portion 32. On the other hand, a hook 34 is provided at the suspending portion 22. The body 35 is suspended from the hook 34. The body 35 can be lifted and lowered continuously by rotating the rotating portion 4 using the rotating device 23. The operation of the second embodiment is the same as that of the first embodiment. Accordingly, the detailed explanation is omitted.

FIG. 4B is a perspective view of the lift shown in FIG. 4A. In FIG. 4B, the body 35 is suspended from the hook 34 provided at the sub-box 30 and the body 35 can be lifted and lowered continuously by rotating portion 4 in the main box 10 using the rotating device 23 provided at the main box 10.

FIG. 4C is a perspective view of the lift shown in FIG. 4A, wherein the main box 10 of the lift and the sub-box 30 are opposite up and down. In FIG. 4C, the body 35 is suspended from the hook 33 provided at the main box 10 and the body 35 can be lifted and lowered continuously by rotating portion 4 in the main box 10 using the rotating device 23 provided at the main box 10. In FIG. 4C, when a board is used instead of the hook 33, the position thereof can be lifted and lowered by rotating the rotating portion 4 in the main box 10 using the rotating device 23 provided over the board at the state of sitting on the board.

Embodiment 3.

FIG. 5 shows another lift of a third embodiment of the present invention. In the third embodiment, the string in the first embodiment is replaced by a belt. Of course the belt may be the string.

The lift shown in FIG. 5 includes a pair of lifts (first lift and second lift) indicated by suffixes x and y. Each lift comprises two rotation portions, the operational principle of which has been explained with respect to FIG. 1. In FIG. 5, the first lift includes two rotation portions, the first rotation portion has a winding reel 6*a*, a friction reel 7*a*, a sliding reel 8*a*. The second rotation portion has a winding reel 6*b*, a friction reel 7*b* and a sliding reel 8*b*. The first lift includes a common rotating shaft 2*x* for rotating the rotating portion 4*x*, a support 3*x* for supporting the common rotating shaft 2*x*, and a common center shafts 21*x* and 21*y*, assist reels 19*a*, 20*a*, 19*b*, 20*b* provided at the common center shaft 21*x*. The second lift includes a common rotating shaft 2*y* for rotating a rotating portion 4*y*, a support 3*y* for supporting the common rotating shaft 2*y*, a common center shaft 21*y*, and assist reels 19*c*, 20*c*, 19*d*, and 20*d* located at the common center shaft 21*y*. A floor board 29 is suspended from the common center shafts 21*x* and 21*y*.

The first rotation portion of the first lift has a first belt and the second rotation portion of the second lift has a second belt.

The first belt includes a belt 13*a* wound on the winding reel 6*a*, a belt 14*a* between the winding reel 6*a* and the first assist reel 19*a*, a belt 15*a* between the first assist reel 19*a* and the friction reel 7*a*, a belt 16*a* between the friction reel 7*a* and the second assist reel 20*a*, a belt 17*a* between the second assist reel 20*a* and a belt terminal end 18*a* looped on the friction reel 8*a*. The second belt includes a belt 13*b* wound on the winding reel 6*b*, a belt 14*b* between the winding reel 6*b* and the first assist reel 19*b*, and a belt 15*b* between the first assist reel 19*b* and the friction reel 7*b*, a belt 16*b* between the friction reel 7*b* and the second assist reel 20*b*, and a belt 17*b* between the second assist reel 20*b* and a belt terminal end 18*b* looped on the friction reel 8*b*. These belts 13*a*–17*a* and 13*b*–17*b* are the same as the strings 13–18 in FIG. 1, so detailed description thereof is omitted. Some of the reference numbers are omitted in order to prevent the complexity of the figure. However, those omitted reference numbers correspond to those in FIG. 1. The four rotation portions from the first to fourth in FIG. 5 are represented by suffixes a, b, c and d, respectively.

The lift of the third embodiment has a lifting string 25*x* and a lowering string 26*x* wound on the rotating portion 4*x*. They are the other realizing means of the rotating device 23 in FIG. 1 and constructed by winding the strings on the rotating portion 4*x*. The lifting string 25*y* and the lowering string 26*y* wound on the rotating portion 4*y* of the second lift are the same as the lifting string 25*x* and lowering string 26*x* wound on the rotating portion 4*x*, so detail description thereof is omitted.

Lifting operation:

When a person sitting on the wheelchair on the floor board 29 pulls down the lifting string 25*x*, the rotating portion 4*x* rotates in the direction for winding the belt 14*a* onto the winding reel 6*a* to make the belt layer 13*a*. At the same time, on the friction reel 7*a* of the rotating portion 4*x*, the belt 16*a* is pulled by the length corresponding to the rotation of the friction reel 7*a*. If the radius Ra of the winding reel 6*a* and the radius ra of the friction reel 7*a* of the rotating portion 4*x* are the same, as explained above, the tension of the belts is applied on the belts 16*a* and 17*a*, but is not applied on the belts 14*a* and 15*a*. Accordingly, the tension is applied on the assist reel 20*a* but not applied on the assist reel 19*a*. In other words, the tension of the belts 15*a* and 16*a* on the friction reel 7*a* becomes 0 and the pressure needed to generate the friction force on the friction reel 7*a* becomes 0, so the friction force becomes 0 and the belt 15*a* slides by being pulled by the belt 16*a*. However, when the belt 15*a* slides by a certain length and the tension of the four belts 14*a*–17*a* becomes equal, the belt 15*a* stops sliding. Thus, the assist reel 20*a* lowers a little bit, then the assist reels 19*a* and 20*a* stop at the position which is above than the former position. According to the plurality of the momentary processes, the assist reels 19*a* and 20*a* are gradually lifted along with the time passing.

When the operation for pulling the pull string 25*x* is stopped, the rotation of the rotating portion 4*x* stops, and the friction is generated on the friction reel 7*a* of the rotating portion 4*x* due to the belts 15*a* and 16*a*. Then, the brake is applied to the rotating portion 4*x*, and the assist reels 19*a* and 20*a* stop at the current position and do not fall down. As a result, if the lifting string 25*x* on the rotating portion 4*x* and the lifting string 25*y* on the rotating portion 4*y* are pulled equal, the floor board 29 coupled to the common center shafts 21*x* an 21*y* lifts gradually with keeping a balance.

The above explanation is the same as that of the winding reel 6*b*, the friction reel 7*b* and the sliding reel 8*b* on the rotating portion 4*x*, and the assist reels 19*b* and 20*b* of the second lift, so the detail description thereof is omitted.

Further the above explanation is the same as that of the winding reel 6*c*, the friction reel 7*c*, the sliding reel 8*c* of the rotating portion 4*y*, and the assist reels 19*c* and 20*c* of the third lift, and the winding reel 6*d*, the friction reel 7*d*, the sliding reel 8*d* of the rotating portion 4*y*, and the assist reels 19*d* and 20*d* of the fourth lift, so the detail description thereof is omitted.

When a person sitting on the wheelchair on the floor board 29 pulls down the lifting string 25*x* and 25*y*, or he or she pulls down the handle of the ratchet by himself or herself, the weight of the person on the floor board 29 is partly worked on the string or the handle. That weight is subtracted from the weight added to the floor board 29, and this is referred to as a counter weight effect. As the result of this counter weight effect, it is possible to lift the floor board 29 with smaller power.

Lowering operation:

When a person sitting on the wheelchair on the floor board 29 pulls down the lifting string 26*x*, the rotating portion 4*x* rotates in the direction for feeding the belt 14*a* from the winding reel 6*a* to release the belt layer 13*a*. At the same time, on the friction reel 7*a* of the rotating portion 4*x*, the belt 15*a* is pulled by the length corresponding to the rotation of the friction reel 7*a*. If the radius Ra of the winding reel 6*a* and the radius ra of the friction reel 7*a* of the rotating portion 4*x* are the same, as explained above, the tension of the belts is applied on the belts 14*a* and 15*a*, but is not applied on the belts 16*a* and 17*a*. Accordingly, the tension is applied on the assist reel 19*a* but not applied on the assist reel 20*a*. In other words, the tension of the belts 15*a* and 16*a* on the friction reel 7*a* becomes 0 and the pressure needed to generate the friction force on the friction reel 7*a* becomes 0, so the friction force becomes 0 and the belt 16*a* slides by being pulled by the belt 15*a*. However, when the belt 16*a* slides by a certain length and the tension of the four belts 14*a*–17*a* becomes equal, the belt 16*a* stops sliding. Thus, the assist reel 19*a* lowers a little bit, then the assist reels 19*a* and 20*a* stop at the position which is lower than the former position. According to the plurality of the momentary processes, the assist reels 19*a* and 20*a* are gradually lowered along with the time passing.

When the operation for pulling the pull string 26*x* is stopped, the rotation of the rotating portion 4*x* stops, and the friction is generated on the friction reel 7*a* of the rotating portion 4*x* due to the belts 15*a* and 16*a*. Then, the brake is applied to the rotating portion 4*x*, and the assist reels 19*a* and 20*a* stop at the current position and do not fall down. As a result, if the lifting string 26*x* on the rotating portion 4*x* and the lifting string 26*y* on the rotating portion 4*y* are pulled equal, the floor board 29 coupled to the common center shafts 21*x* an 21*y* lowers gradually with keeping a balance.

The above explanation is the same as that of the winding reel 6*b*, the friction reel 7*b* and the sliding reel 8*b* on the rotating portion 4*x*, and the assist reels 19*b* and 20*b* of the second lift, so the detail description thereof is omitted.

Further the above explanation is the same as that of the winding reel 6*c*, the friction reel 7*c*, the sliding reel 8*c* of the rotating portion 4*y*, and the assist reels 19*c* and 20*c* of the third lift, and the winding reel 6*d*, the friction reel 7*d*, the sliding reel 8*d* of the rotating portion 4*y*, and the assist reels 19*d* and 20*d* of the fourth lift, so the detail description thereof is omitted.

Embodiment 4.

Figure 6:
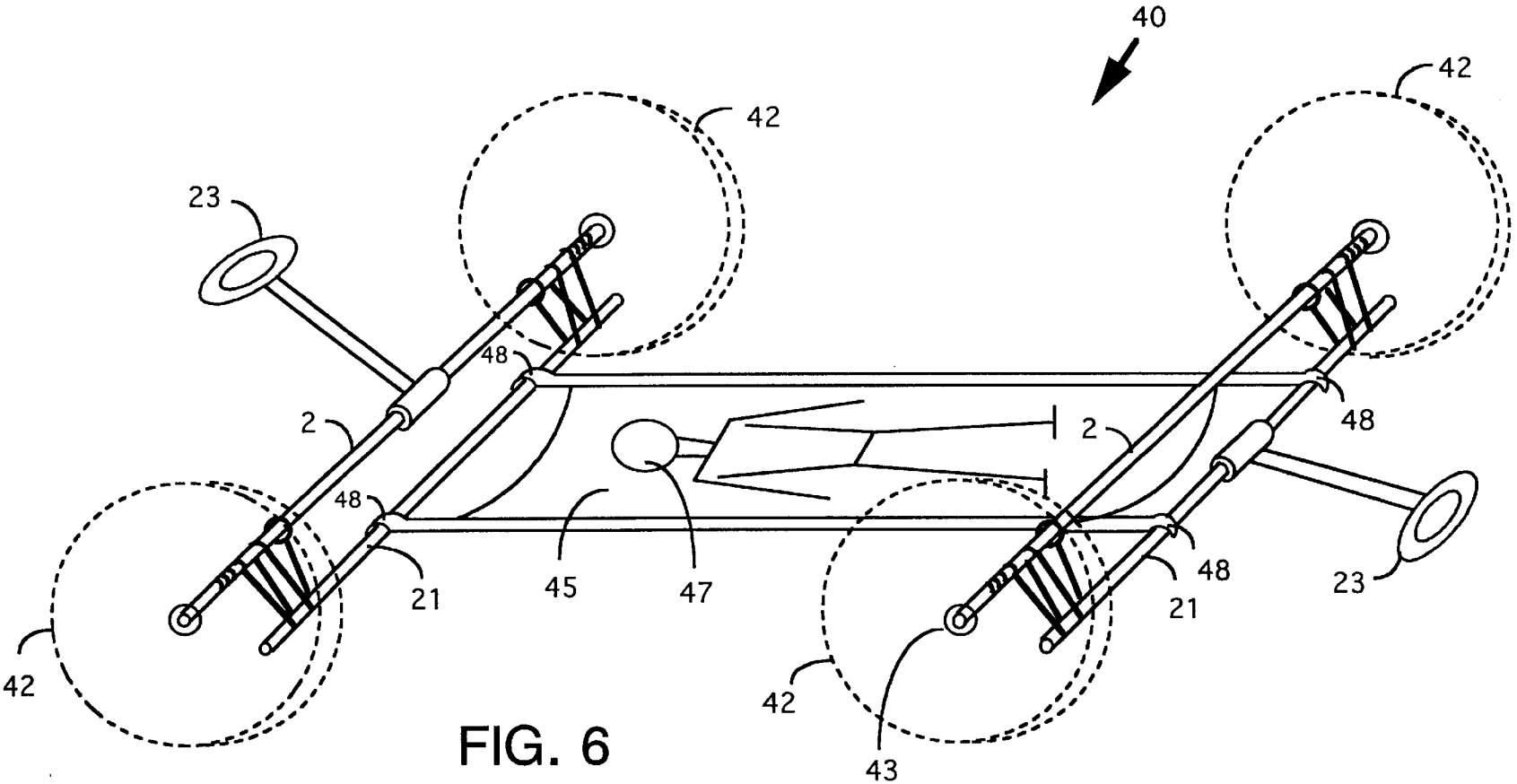
FIG. 6 shows a moving stretcher for lifting and lowering a stretcher of a fourth embodiment of the present invention.

FIG. 6 shows a moving stretcher for lifting and lowering a stretcher of a fourth embodiment of the present invention. The moving stretcher 40 of the fourth embodiment comprises two sets of the lifts of the first embodiment. In FIG. 6, the moving stretcher 40 uses the common rotating shaft 2 of the present invention as a shaft of the wheel 42. The common rotating shaft 2 is coupled to a wheels 42 via bearings 43. A rotation means 23 having a handle is arranged to the common rotating shaft 2. Further, the handle has knob on the top end thereof so as to carry the moving stretcher 40 easily. In the moving stretcher 40, the handle rotates the winding reel 6, a friction reel 7 and a sliding reel 8 arranged to the common rotating shaft 2 to lift and lower the common center shaft 21.

Upon operating the moving stretcher 40, end hooks 48 of the stretcher 45 where the patient 47 is lying is engaged on the common center shaft 21 as shown in FIG. 6. The common center shaft 21 is lifted by operating the handle of the rotating device 23 up and down and then the stretcher is lifted up from the ground. The stretcher where the patient is lying can be moved to any places by moving the moving stretcher 40.

In this way, according to the present embodiment, the helper can lift and move the patient by himself or herself. Further, it is possible to lower the stretcher 45 slowly and safely by operating the handle 23 up and down.

The operation of the lift used for the moving stretcher of the fourth embodiment is the same as the lift in the first embodiment, so the detailed description thereof is omitted.

Embodiment 5.

Figure 7:
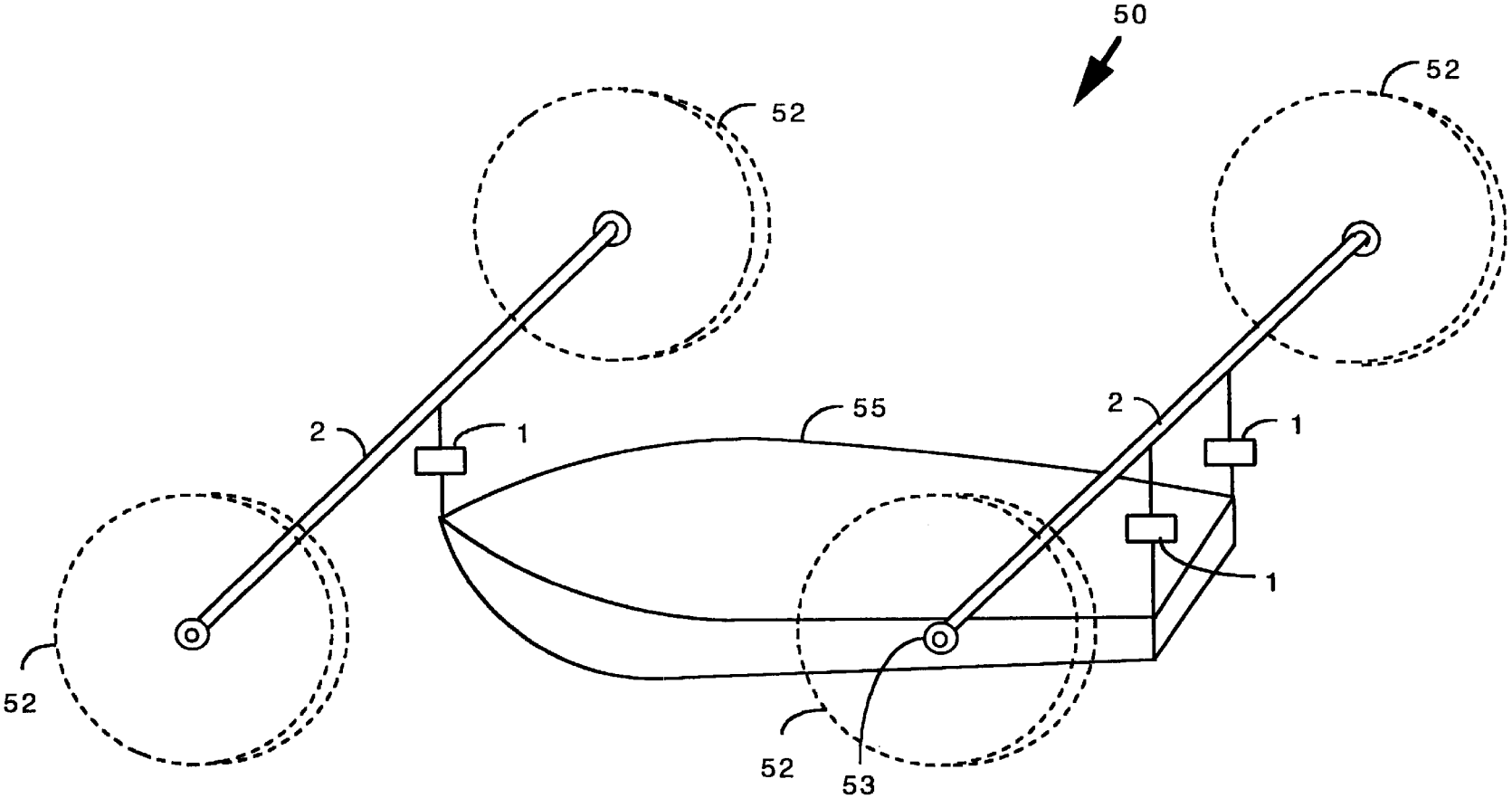
FIG. 7 shows a carrier with a lift for lifting body of a fifth embodiment of the present invention.

FIG. 7 shows a carrier 50 with three lifts of the second embodiment of the present invention. The carrier 50 of FIG. 7 uses a plurality of the lifts 1 of the second embodiment of the present invention, which are suspended to shafts 1 of wheels 52 to lift or lower the object (e.g. boat) 55. The shaft 2 is coupled to the wheels 52 via bearings 53. In the fifth embodiment of the present invention, one end of the lift is suspended from the shaft 2 and other end of the lift suspends a boat 55. The lift 1 is constructed in the same ways as that of the embodiment 2, and includes a winding reel 6, a friction reel 7 and a sliding reel 8, and a rotating device 23 (not shown). In FIG. 7, the lift 1 suspends the boat 55 directly, but it is possible to suspend the board on which the boat 55 is put on.

In order to operate the carrier 50 of FIG. 7, the winding reel 6, the friction reel 7 and the sliding reel 8 provided on the common rotating shaft 2 of the lift 1 are rotated using the rotating device 23 provided on the lift 1 to lift and lower the common center shaft 21. In this way, it is possible to lift and move a heavy boat alone on the beach. Further, it is possible to lower the heavy boat slowly and safely by operating the handle up and down.

The operation of the lift used in the carrier of the fifth embodiment is the same as that of the second embodiment, so the detailed description thereof is omitted.

In the present invention, the carrier 50 using the lift 1 of the second embodiment is cited as an example for lifting a boat. However, it can be used for lifting, lowering and moving any other bodies in addition to the boat.

The present invention can be used for other ways than that described above. For example, it is used for a lift for going up or going down the stairs, a lift for adjusting the height of a wheelchair's scat to reach a cooking table or a wash stand, a lift for suspending a seat for taking a bath, a lift for helping a toilet, a lift for lifting and lowering a floor board of a nursing bed, a lift for adjusting the height of a hammock, a lift for adjusting the height of a suspending shelf, a lift used for entering and take out a wheelchair in/from a car, a lift for replacing a bed sheet or a futon (bedding) for a person in bed and other lifts for lifting many kinds of objects.

It can be also used as a working lift for self-adjusting the height of a working table for trimming trees or cleaning windows, a swing whose height is changeable, and a wire tensing machine for loosening and removing tensed cable wires in a wiring work of electric and communication cables.

In the present invention, man power is used for operating the rotating device 23, however, electric power may also be used for operating the rotating device 23.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lift for lifting and lowering an object, the lift comprising:

a first rotating portion including a first winding reel, a first friction reel, and a first sliding reel, the first winding, friction, and sliding reels being unified;

a second rotating portion including a second winding reel, a second friction reel, and a second sliding reel, the second winding, friction, and sliding reels being unified;

a common rotating shaft penetrating the center of the first and second rotating portions for supporting the first and second rotating portions;

a rotating device for rotating the first and second rotating portions;

a first string having a first end fixed on a circumference of the first winding reel and wound plural times thereon, then reaching and rounding a first assist reel, then reaching and rounding the first friction reel, and then reaching and rounding a second assist reel, the second end of the first string being looped on the first sliding reel;

a second string having a first end fixed on a circumference of the second winding reel and wound plural times thereon, then reaching and rounding a third assist reel, then reaching and rounding the second friction reel, and then reaching and rounding a fourth assist reel, the second end of the second string being looped on the second sliding reel; and a common center shaft penetrating the center axes of the first, second, third, and fourth assist reels, wherein the common center shaft is parallel to the common rotating shaft of the first and second rotating portions.

2. The lift according to claim 1 wherein the first and second strings comprise belts.

3. The lift according to claim 1 wherein the common rotating shaft is supported by supports.

4. The lift according to claim 1 wherein the common rotating shaft comprises a shaft of the reels and further comprising a board for carrying a body, the board being engaged to the common center shaft.

5. The lift according to claim 2 wherein the common rotating shaft is supported by supports.

6. The lift according to claim 2 wherein the common rotating shaft comprises a shaft of the reels and further comprises a board for carrying a body, the board being engaged to the common center shaft.

7. The lift according to claim 1 further comprising a suspending portion coupled to the common center shaft for suspending a body.

8. The lift according to claim 2 further comprising a suspending portion coupled to the common center shaft for suspending a body.

* * * * *